United States Patent [19]

Dolinar

[11] Patent Number: 4,588,638

[45] Date of Patent: May 13, 1986

[54] DUNNAGE MATERIAL

[75] Inventor: Blair E. Dolinar, St. Louis, Mo.

[73] Assignee: The Dow Chemical Company, Midland, Mich.

[21] Appl. No.: 725,022

[22] Filed: Apr. 19, 1985

Related U.S. Application Data

[63] Continuation-in-part of Ser. No. 604,096, Apr. 26, 1984, abandoned.

[51] Int. Cl.[4] ..... B32B 27/00; B32B 27/08

[52] U.S. Cl. ..... 428/339; 428/407; 428/424.6; 428/424.2; 428/424.8; 428/484; 428/517; 428/518; 428/520; 267/136

[58] Field of Search ..... 428/339, 407, 424.6, 428/424.2, 424.8, 517, 484, 518, 520

[56] References Cited

U.S. PATENT DOCUMENTS

| | | | |
|---|---|---|---|
| 3,066,382 | 12/1962 | Zweigle et al. | 28/78 |
| 3,292,859 | 12/1966 | Landon | 239/9 |
| 3,344,973 | 10/1967 | Studen | 229/14 C |
| 3,933,959 | 1/1976 | Skochdopole et al. | 428/369 |
| 4,104,440 | 8/1978 | Collins | 428/402 |

*Primary Examiner*—Patricia C. Ives

*Attorney, Agent, or Firm*—Dan R. Howard; Thomas J. Mielke

[57] ABSTRACT

Loose fill packing material comprising a plurality of expanded, resilient, thermoplastic dunnage particles, which particles are rendered more effective by coating an outer surface thereof with an additive which additive results in the packing material having improved cushioning properties and reduces the tendency of articles to migrate through the dunnage particles, wherein the particles have an average maximum cross-sectional dimension of at least 0.5 inch.

15 Claims, No Drawings

DUNNAGE MATERIAL

CROSS REFERENCE TO RELATED APPLICATION

This is a continuation-in-part of application Ser. No. 604,096 filed Apr. 26, 1984, now abandoned.

BACKGROUND OF THE INVENTION

This invention relates generally to (a) a dunnage material, (b) preparation of such dunnage material and (c) use of such dunnage material.

Dunnage materials such as foamed plastic particles or strands are known to be highly desirable for use in packaging articles. The foamed particles or strands protect articles in shipping by absorbing shock and by isolation of the articles from shipping container walls. Typical particles or strands are set forth in U.S. Pat. Nos. 3,188,264 and 3,723,240.

Dunnage materials are usually placed beneath, around the sides of, and atop articles being packaged in order to isolate the articles from container walls. Packaging relatively light articles in this manner is generally effective. Packaging delicate but relatively heavy articles, such as electronic or optical equipment, in this manner is less effective.

It has been found that relatively heavy articles tend to "migrate", or move through, the dunnage materials due to vibration or handling. For example, in shipments in a truck, van, or rail car, migration of these heavy articles frequently continues until contact is made with a shipping container wall and breakage or other damage occurs. Breakage from this and other causes may be as much as fifteen percent, or even higher, especially where prolonged shipment or handling is involved.

A number of attempts have been made to reduce migration through dunnage materials.

Holden, in U.S. Pat. No. 3,188,264, discloses particles having a number surface indentations to promote interlocking between particles.

Skochdopole et al., in U.S. Pat. No. 3,723,240, discloses asymmetrically foamable strands which curl upon foaming to form a generally helical structure. The helical structures interlock to a degree when placed under pressure.

Humbert et al., in U.S. Pat. No. 3,251,728, disclose a dunnage material consisting essentially of a tangled interlocking mass of non-linear, elongated pieces of foamed polymer.

Graham, in U.S. Pat. No. 3,047,136, discloses a dunnage material which consists of a plurality of strings of hollow crushable cylinders, each of the strings being partially cut through at spaced intervals. A resilient or rubbery outer coating may be applied to the strings to reduce sliding of the strings relative to each other as well as to supplement interlocking between the strings.

SUMMARY OF THE INVENTION

This invention concerns a loose fill packing material comprising a plurality of expanded, resilient, thermoplastic, synthetic resinous dunnage particles, which particles comprise an amount of an additive deposited on at least a portion of an outer surface area of a majority of said dunnage particles which additive results in the packing material having improved cushioning properties and reduces the tendency of articles to migrate through the dunnage particles, wherein the particles have an average maximum cross-sectional dimension of at least 0.5 inch.

Additionally, the invention concerns a method for preparing loose fill packing material in the form of foamed dunnage particles, the method comprising a series of sequential steps, the steps being:

(a) providing a heat plastified mass of synthetic resinous material containing an expanding agent, the heat plastified mass being capable of expansion to form a mass containing a plurality of closed gas-filled cells;

(b) maintaining the heat plastified mass under pressure;

(c) extruding the heat plastified mass, the mass being extruded as an extrudate from a shaping configuration;

(d) converting the extrudate into a plurality of elements;

(e) depositing an additive on at least a portion of an outer surface area of a majority of the foamed particles which additive results in the packing material having improved cushioning properties and reduces the tendency of articles to migrate through the foamed particles, wherein the foamed particles have an average maximum cross-sectional dimension of at least 0.5 inch.

Finally, the invention concerns a method for packaging an article with a plurality of expanded, resilient, thermoplastic dunnage particles, which particles comprise an amount of an additive deposited on at least a portion of an outer surface area of a majority of said dunnage particles which additive results in the packing material having improved cushioning properties and reduces the tendency of articles to migrate through the dunnage particles, wherein the particles have an average maximum cross-sectional dimension of at least 0.5 inch, the method comprising:

(a) providing a packaging container, the container having at least one wall, a top, and a bottom, the container also being of sufficient size to contain (1) at least one article to be packaged and (2) an amount of dunnage particles sufficient to space the article from the wall, the top and the bottom of the container;

(b) adding a quantity of the dunnage particles to the packaging container, the quantity being sufficient to provide a layer of adequate thickness to space the article to be packaged from the bottom of the container;

(c) placing the article to be packaged on the layer of dunnage particles;

(d) adding a further quantity of dunnage particles to the packaging container, the further quantity being placed about the sides, within and on top of the article to space it from the walls and the top of the container and from other articles, the further quantity being sufficient to provide a slight overfill of the packaging container; and (e) closing the packaging container to slightly compact the dunnage particles by pushing down on the overfill.

DESCRIPTION OF THE PREFERRED EMBODIMENTS

Dunnage particles suitable for use in the present invention are readily prepared from a wide variety of synthetic, resinous, thermoplastic polymers.

One group of suitable thermoplastic polymers includes polymers which comprise, in chemically combined form, at least about seventy (70) percent by weight of at least one alkenyl aromatic compound having the general formula

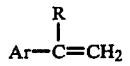

wherein Ar represents an aromatic hydrocarbon or a nuclear halohydrocarbon radical of the benzene series, and R is hydrogen or a methyl radical. Examples of such alkenyl aromatic polymers are homopolymers of styrene, alpha-methylstyrene, ortho-, meta-, and para-methylstyrene, Ar-ethylstyrene, tertiary-butylstyrene and Ar-chlorostyrene; the copolymers of two or more of such alkenyl aromatic compounds with one another; and copolymers of one or more of such alkenyl aromatic compounds with minor amounts of other readily polymerizable olefinic compounds such as divinylbenzene, methylmethacrylate, or acrylonitrile, and the like.

A second group of suitable thermoplastic polymers includes aliphatic olefin polymers which are normally solid polymers obtained by polymerizing at least one alpha-mono-olefinic aliphatic hydrocarbon containing from 2 to 8 carbon atoms per molecule. Illustrative hydrocarbons include ethylene, propylene, butene-1, pentene-1, 3-methylbutene-1, 4-methypentene-1, 4-methylhexene-1, and 5-methylhexene-1. The hydrocarbons may be polymerized alone, with one another, or with various other polymerizable compounds. The polymers of ethylene or propylene alone are desirable because they produce tough, resilient and fine-celled, chemically inert products.

Examples of suitable polymerizable organic compounds which can be polymerized with ethylene or propylene are vinyl acetate; $C_1$–$C_4$ alkyl acrylates, such as ethyl acrylate; styrene; lower alkyl esters of methacrylic acid, such as methylmethacrylate; tetrafluoroethylene; and acrylonitrile.

Copolymers containing, in chemically combined form, 75 percent by weight or more of ethylene or propylene with not more than 25 percent of one or more of such other polymerizable organic compounds also produce suitable results.

The aliphatic olefin polymers can be modified by blending with polymeric materials. Illustrative polymeric materials include polyisobutylene, acrylonitrile/-butadiene rubbers, poly(2-chlorobutadiene-1,3), polyisoprene, ethylene/acrylic acid copolymers and ethylene/vinylacetate copolymers.

A third group of suitable thermoplastic polymers includes halogenated aliphatic olefin polymers, as well as polymers of a wide variety of ethylenically unsaturated monomers which produce foamable thermoplastic compositions. Illustrative polymers include those prepared by polymerizing isopropenyl toluene; vinyl naphthalene; esters of alpha-methylene aliphatic monocarboxylic acids, such as methyl acrylate, ethyl acrylate, n-butyl acrylate, isobutyl acrylate, dodecyl acrylate, 2-chloroethyl acrylate, 2-chloropropyl acrylate, 2,2'-dichloroisopropyl acrylate, phenyl acrylate, cyclohexyl acrylate, methyl alpha-chloroacrylate, methylmethacrylate, ethylmethacrylate and methylethacrylate; nitriles such as acrylonitrile and methacrylonitrile; vinyl esters such as vinyl acetate, vinyl chloroacetate, vinyl propionate, vinyl butyrate, vinyl laurate and vinyl stearate; vinyl ethers such as vinyl methyl ethers, vinyl isobutyl ethers and vinyl 2-chloroethyl ether; vinyl ketone; methyl isopropenyl ketone; isobutylene; vinylidene halides, such as vinylidene chloride and vinylidene chlorofluoride; N-vinyl compounds such as N-vinyl pyrrole, N-vinyl carbazole, N-vinyl indole, N-vinyl succinimide, acrolein, methacryolein, acrylamide, methacrylamide and N-methylol acrylamide; and allyl compounds such as allyl alcohol, methallyl alcohol, allyl acetate, allyl methacrylate, allyl lactate, allyl alpha-hydroxyisobutyrate, allyl trichlorosilane, allyl acrylate, methallyl phosphate, and the like.

The dunnage particles suitable for use in the present invention are prepared by expanding or foaming the described synthetic, resinous, thermoplastic polymers. Methods of forming the dunnage particles of the present invention are well-known in the prior art. Exemplary of suitable methods are the methods described in U.S. Pat. Nos. 3,026,272 and 3,026,273.

The dunnage particles suitable for use in the present invention can be formed in a variety of shapes and sizes. A dunnage particle of any shape which is capable of being coated with the additive of the present invention and which meets the size requirements set forth herein is suitable for use in the present invention. Generally, dunnage particles having a somewhat irregular shape are believed to be beneficial for use in the present invention.

Applicants have discovered that desirable cushioning properties are achieved when the dunnage particles have an average maximum cross-sectional dimension of at least 0.5 inch. The phrase "average maximum cross-sectional dimension" refers to the value determined by measuring the maximum cross-sectional dimension for a number of individual particles, and then determining the average of those measured values. The number of particles used in determining the average maximum cross-sectional dimension should be a statistically significant, random sample for a given population of particles.

The additive is deposited on at least a portion of an outer surface area of a majority of said dunnage particles. The additive is generally deposited on the dunnage particles after the dunnage particles have been expanded. Suitable additives result in the packing material having improved cushioning properties and reduce the tendency of articles to migrate through the dunnage particles. It is often desirable to deposit the additive on a major portion of an outer surface area of a majority of said dunnage particles.

In order to determine whether an additive is suitable for use in the present invention two tests were developed, a modified peel test and a vibrational settling test. The tests are set forth in detail hereinafter.

Suitable additives were found to provide, under the modified peel test hereinafter described, a peel strength of at least about 1.5 grams per centimeter. The additive beneficially provides a peel strength of greater than about 9 grams per centimeter. The additive desirably provides a peel strength of about 150 grams per centimeter. Greater peel strength is acceptable but not necessary for most applications.

Additionally, suitable additives were found to provide an overall settling value, under the vibrational settling test hereinafter described, of less than about 65, beneficially less than about 45, desirably less than about 30 and preferably less than about 25.

The additives of the present invention when deposited on the dunnage particles of the present invention, result in the packing material having improved cushioning properties and reduce the tendency of articles to migrate through the dunnage particles. That is to say, dunnage particles, according to the present invention, treated with additives according to the present invention and employed as herein described will have improved cushioning properties when compared to essentially the same dunnage particles which have not been treated with additives according to the present invention.

Materials suitable for use as additives in the present invention include materials generally described as adhesives, tackifiers, or friction enhancing aids. Examples include synthetic polymer latexes, pressure sensitive adhesives and glues, low molecular weight polymers, waxes, contact cements, starch derived adhesives, urethane adhesives, protein derived adhesives and the like.

Low molecular weight polymers, as used herein, are those polymers which have a ring and ball softening point of greater than about 30° Centigrade, preferably greater than about 5° Centigrade. Ring and ball softening points are determined in accordance with American Society for Testing and Materials Test E-28.

Starch derived adhesives include pastes, such as wheat paste, dextrins, borated dextrins, jelly gums and the like. Suitable starches are those represented by the formula $(C_6H_{10}O_5)_n$ where n=1 to about 1,000,000.

Protein derived adhesives include animal glue, casein and the like.

Useful synthetic polymer latexes are those which meet the aforementioned criteria and which are aqueous colloidal suspensions of particles of a polymer. Suitable polymer particles are obtained by emulsion polymerization or suspension polymerization. The latexes are generally stabilized by addition of one or more suitable surface active agents.

Suitable latexes include those based on, for example, styrene-butadiene copolymers, acrylic copolymers, butadiene acrylonitrile polymers, vinylidene chloride copolymers, vinyl chloride copolymers and copolymers of vinyl alkanoates, such as vinyl acetate.

Beneficial results are obtained when the polymer latex contains a carboxyl functionality. A suitable level of carboxyl functionality is from about 0.01 to about 25 percent by weight of polymer. The carboxyl functionality is obtained by including one or more alpha,beta-olefinically unsaturated carboxylic acid monomers with other polymerizable monomers to be used in preparing the aforementioned latexes.

Suitable carboxylic acid monomers contain from about three to about twelve carbon atoms per molecule. Such acid monomers include acrylic acid, methacrylic acid, ethacrylic acid, alpha-chloroacrylic acid, alpha-cyanoacrylic acid, crotonic acid, beta-acryloxypropionic acid, hydrosorbic acid, sorbic acid, alpha-chlorosorbic acid, cinnamic acid, beta-styrylacrylic acid, itaconic acid, citraconic acid, maleic acid, fumaric acid, mesaconic acid, aconitic acid and the like. Beneficial results are obtained with carboxylic acid monomers containing from three to six carbon atoms per molecule such as acrylic acid, methacrylic acid and the like.

Satisfactory results are obtained when the additive is a latex of a styrene-butadiene copolymer which has a carboxyl functionality. Such copolymers typically have polymerized therein (a) styrene in an amount of from about 40 to about 70 percent by weight of copolymer, (b) butadiene in an amount of from about 15 to about 40 percent by weight of copolymer, and (c) carboxylic acid monomer(s) in an amount of from about 0.1 to about 20 percent by weight of copolymer.

Acrylic copolymers typically have polymerized therein (a) one or more alkyl acrylates which contain from about one to about eighteen carbon atoms per alkyl moiety and (b) one or more monomers which are copolymerizable therewith. The alkyl acrylates beneficially have from about four to about ten carbon atoms per alkyl moiety. Illustrative alkyl acrylates include butyl acrylate, amyl acrylate, hexyl acrylate, heptyl acrylate, octyl acrylate, nonyl acrylate, decyl acrylate and various isomers of these acrylates such as isooctyl acrylate and 2-ethylhexyl acrylate.

Satisfactory results are obtained when the additive is an acrylic copolymer or interpolymer which has polymerized therein (a) from about 40 to about 80 percent by weight of polymer of at least one alkyl acrylate and (b) from about 20 to about 60 percent by weight of polymer of at least one ethylenically unsaturated monomer which is copolymerizable therewith.

Illustrative copolymerizable ethylenically unsaturated monomers include alpha-olefins containing from 2 to 10 carbon atoms; vinyl esters of alkanoic acids containing 3 to 10 carbon atoms, such as vinyl acetate and vinyl octoate; ethyl and methyl esters of methacrylic acid; styrene; vinyl chloride; and the like.

Vinyl chloride latexes which contain either vinyl chloride homopolymer or interpolymers of vinyl chloride also provide satisfactory results. Vinyl chloride interpolymers typically have polymerized therein from about 50 to about 97 percent by weight of polymer of vinyl chloride and from about 3 to about 50 percent by weight of polymer of at least one ethylenically unsaturated monomer which is copolymerizable therewith. Illustrative copolymerizable monomers include the alkyl acrylates hereinabove specified, the vinyl esters of alkanoic acids hereinabove specified, alkyl esters of methacrylic acid containing from about one to about four carbon atoms per alkyl moiety, vinylidene chloride and the like.

Latexes are desirably prepared by emulsion polymerization using anionic or nonionic surfactants or mixtures thereof. Suitable anionic surfactants include sodium dioctyl sulfosuccinate, sodium diamyl sulfosuccinate, sodium dihexyl sulfosuccinate, sodium lauryl sulfate, sodium dodecyl benzene sulfonate, etc. The nonionic surfactants which may be considered exemplary include nonyl or octyl phenoxypolyethoxyethanol condensates wherein the ethylene oxide content may vary from 5 to 50 moles. Conventionally, two or more of these nonionic surfactants may be employed. Latex preparation is achieved using conventional polymerization methods. While emulsion polymerization methods are desirably used to prepare the latexes, any method of polymerization which results in a latex capable of being used according to the present invention can be suitably employed.

Polymer latexes containing up to about 60 percent by weight total polymer solids may be conveniently sprayed. For optimum results, solids concentrations of 35 to 55 percent are preferred.

Any spraying method capable of atomizing the additive may be employed. Accordingly, the particular method of spraying is not critical to production of the improved dunnage particles of the present invention. Thus, air, airless or aerosol systems may be employed. Low fluid delivery rates and low atomization pressures are advisable since these will minimize "overspray and misting" of the adhesive into the surrounding atmosphere. The fluid delivery system most suitable is an airless spray system in combination with a pneumatic pump. Other suitable spraying equipment includes a pressurized vessel in combination with conventional air spray equipment.

The additive to be sprayed is generally delivered into the spray equipment at a rate of about 50 to 500 wet grams per minute, preferably about 100 to 400 wet grams per minute. The amount of atomization pressure required will be proportionate to the adhesive delivery rate and will typically range from 35 to 550, preferably 70 to 550 kilopascals (kPa).

Application of the additive to foamed dunnage particles is not limited to spray equipment and methods using such spray equipment. Accordingly, additives may be applied by brush, by roller or by any other means so long as a sufficient quantity of additive is applied to the dunnage particles.

The dunnage particles of the present invention if prepared and dried in advance of packaging, may be readied for use simply by applying a light water mist or steam spray to the surface thereof. The mist or spray may be applied to the dunnage particles prior to, simultaneously with, or subsequent to addition to a packaging container. If the dunnage particles have clumped together, as is the case where the dunnage particles are being re-used, the mist or spray beneficially wets the additive sufficiently to allow the dunnage particles to separate into individual particles or small, but useable, clumps.

The peel strengths and overall settling values specified hereinabove are readily obtained with an amount of additive of from about 1400 to about 6000 grams of wet additive per cubic meter of foamed dunnage material. Beneficial results are obtained with an amount of additive of from about 1600 to about 3400 grams of wet additive per cubic meter of foamed dunnage material.

Amounts of wet additive of up to 10,000 and more grams of wet additive per cubic meter of dunnage are capable of being used. Such amounts are, however, excessive and may be undesirable for several reasons such as cost effectiveness, uneconomical drying rates and damage to the article(s) being packaged.

Amounts of additive of less than about 1400 grams of wet additive per cubic meter of foamed dunnage material are unsatisfactory because they do not provide sufficient coverage of the foamed dunnage material.

It is necessary that the additive be deposited on at least a portion of an outer surface area of a majority of the dunnage particles. Moreover, in the case where the additive is sprayed on the dunnage particles it is desirable, and often a function of the spraying process, that the additive be deposited somewhat randomly over a portion of an outer surface area of the dunnage particles.

Depending on the additive chosen for use in the present invention certain conditions may be necessary to achieve the maximum improvement in cushioning properties. The improved cushioning properties result from the additive's ability to reduce the tendency of articles to migrate through the dunnage particles. It is, therefore, desirable to employ conditions which result in maximizing the additive's ability to reduce the tendency of articles to migrate through the dunnage particles.

For example, in those cases wherein the additive employed dries to leave a generally non-tacky surface it is often desirable, to allow the additive to dry while in contact with other dunnage particles thus promoting an adhesion between the particles. This is easily achieved by packaging an article to be shipped with loose fill packing material according to the present invention before the additive dries. If, on the other hand, the additive employed dries to leave a somewhat tacky surface, it becomes less necessary to allow the additive to dry while in contact with other dunnage particles.

The dunnage particles of the present invention provide a number of advantages over conventional dunnage particles which are identical save for the application of additives herein described.

One advantage is that the dunnage particles of the present invention provide lower vibrational settling values than conventional dunnage particles. In other words, migration of articles through the dunnage particles of the present invention is less likely than with conventional dunnage particles.

A second advantage is that the dunnage particles of the present invention, when used in packaging, provide improved cushioning properties. "Cushioning properties" refers to the amount of shock a cushion of a known strength and thickness will allow to be transfered to an article having a particular static loading when dropped from a given height. The dunnage particles of the present invention possess cushioning properties which are improved when compared to conventional dunnage particles.

The cushioning properties of the dunnage particles of the present invention are improved in that such values are reproducible. Conventional dunnage particles provide erratic, non-reproducible cushioning properties. Reproducibility of cushioning properties is desirable since it allows for packages to be designed with a minimum amount of cushioning material which packages still provide a constant level of protection.

Additionally, the cushioning properties of dunnage particles according to the present invention generally provide a desirable level of protection (acceptable level of transmitted shock) over a broader range of static loadings. This allows for simpler package design since a given thickness of cushion will provide an acceptable level of transmitted shock for more static loadings and hence for a broader range of articles to be packaged.

A third advantage is that the dunnage particles of the present invention tend to stick together until pulled apart, particularly when the additive is an adhesive, a glue, a contact cement and the like. Conventional dunnage particles have no tendency to stick together.

The third advantage is particularly evident when a packaged article is removed from a package. Conventional dunnage particles are known to spill over the edge of the package and to scatter over the surface upon which the package is resting. Picking up the scattered dunnage particles is time consuming and bothersome. The dunnage particles of the present invention will, depending upon the amount of additive, be removed from the package either as several small clumps of particles or as a few large masses of particles. Accordingly, cleaning up is very easy.

A fourth advantage is that by varying the amount of additive applied to the dunnage particles, a broad spectrum of package properties can be attained. In other words, it is possible to tailor the dunnage particles to meet a specific need. With conventional dunnage particles, there is a very narrow spectrum of package properties.

These advantages are attained with relatively low levels of additive. Application of the additive to the dunnage particles is neither complicated nor expensive. At relatively low levels of additive, drying time is short thereby providing minimal interference with normal package handling procedures.

Modified Peel Test

General purpose polystyrene film having one side surface sulfonated was used for the peel test. The film had a thickness of 6.35 microns and was commercially available from The Dow Chemical Company under the trade designation Trycite® 1101. Samples having a size of 2.54 centimeters in width and 33 centimeters in length were cut from the film so that the latter dimension was in the machine direction.

The samples were prepared for peel testing in the following manner. Using a #10 Meyer rod, one end of the sulfonated side of the film sample was coated for a distance of about ten centimeters with an additive. The film sample was then folded over so that an equal distance of sulfonated surface from the other end of the sample was in intimate contact with the coated portion. The film samples were then placed in a dessicator and aged for a period of 72 hours. The dessicator had a relative humidity of from about 17 to about 20 percent and a set temperature of from about 21° to about 24° Centigrade.

After aging, the samples were removed from the dessicator. The samples had a bonded end and a loop end. The loop end was then cut to yield two "free" ends of approximately equal length. The "free" ends had no additive coated thereon.

An Instron Universal Testing Machine, Model Number 1123, was used to determine peel strength. The Instron testing machine had two sets of jaws which were spaced apart and opposite each other. One set of jaws was stationary and affixed to the machine. The other set of jaws was attached to a load cell which in turn was attached to the mobile crosshead of the machine.

The free ends of the samples were placed into the two sets of jaws. One free end was clamped by the stationary set of jaws. A second free end was clamped by the set of jaws attached to the load cell. The crosshead of the machine was actuated so as to move the set of jaws attached to the load cell away from the stationary set of jaws at a speed of either 200 or 254 millimeters per minute. The crosshead speed had no effect upon peel strength. The samples were pulled apart until they separated along their entire length. The load cell registered the peel strength for the sample.

Vibrational Settling Test

The purpose of this test was to determine whether an article packaged in dunnage material moved due to vibration and, if so, how much. The test was a modified version of the vibrational settling test described in Federal Specification PPP-C-1683, Section 4.9 for expanded polystyrene loose-fill cushioning material.

About 57,000 cubic centimeters of dunnage material were placed in an open-topped box. The box measured 100 centimeters in length by 60 centimeters in width by 60 centimeters in height. A 0.635 centimeter mesh screen was placed over the opening in the box.

A Craftsman Model 919.1561410 spray gun, having a capability for either internal or external fluid to air mixing and being commercially available from Sears, Roebuck and Co., was used to spray an admixture of a dye and an additive down through the screen onto the dunnage material. The dye was used to provide a visual indicator of coverage of the additive onto the dunnage material. The spray gun had a reservoir portion into which the admixture was placed for application thereof onto the dunnage material. The reservoir portion was pressurized to a pressure of 275 kilopascals gauge in order to provide a consistent flow rate of about 0.11 liters of admixture per minute. The flow rate provided a force of spray sufficient to cause a mixing of the dunnage material with the box.

Spraying was continued until a visual inspection of the dunnage material showed that a generally uniform coating of the admixture was deposited on the dunnage material.

The rate of spray, in terms of wet grams of additive per minute, varied with the additive being applied. In other words, as density of the additive changed, the rate of spray also changed. By way of example only, an additive having a specific gravity of about 1.0 at a temperature of 24° Centigrade had, when applied using the aforementioned spray gun at a pressure of 275 kilopascals gauge, a flow rate of from about 100 to about 140 wet grams of additive per minute for a nominal flow rate of 125 wet grams of additive per minute.

A cardboard test box having interior dimensions 30 centimeters by 30 centimeters by 30 centimeters was filled about halfway with the coated dunnage material. A load box having exterior dimensions of 15 centimeters by 15 centimeters by 15 centimeters and weighing either 2.4 or 7.3 kilograms was placed into the test box in such a manner as to yield a 7.6 centimeter (±2.54 centimeter) gap between the top of the load box and the top of the test box. The 2.4 kilogram load box was used to supply 1035 Newtons per square meter loading. The 7.3 kilograms load box was used to supply a 3105 Newtons per square meter loading.

An additional amount of coated dunnage material was added to the test box to fill it even with the top of the test box. Consistent with recommended packaging guidelines for expanded, thermoplastic loose-fill dunnage materials, the test box was then overfilled with a pyramid or crown of the coated dunnage material. The crown had a depth of about 2.54 centimeter, the depth being measured from the top of the test box to the top of the crown. The lid of the box was then closed and taped shut with fiberglass reinforced tape.

After being closed, the test boxes and their contents were allowed to dry at a temperature of 21° ±9° Centigrade for a period of about sixteen hours. No specific control of humidity or of temperature was attempted during drying.

A small hole, measuring 0.356 centimeters in diameter, was made in the center of the top of the test box.

A stiff piece of stainless steel wire, also 0.356 centimeters in diameter, was inserted into the hole and thereafter pushed through the dunnage material until it contacted the top of the load box. The length of wire between the top of the test box and the top of the load box was measured and recorded as "initial displacement".

The test box and its contents were placed on a table capable of vibrating at a frequency of 4.5 Hertz with a vertical displacement of 2.54 centimeters. The table was designated as an MTS Series 840 Servohydraulic Vibration Test System and was commercially available from MTS Systems Corporation.

The table had a square sample receiving surface which measured 90 centimeters on a side. An internally screw threaded aperture having a diameter of 0.953 centimeter had been machined into the sample receiving surface at each corner thereof. An externally screw threaded rod was threadably engaged with each of the threaded apertures. Four rubber strips measuring 66 centimeters long by 1.91 centimeters wide by 0.64 centimeter thick and having hooks attached to each end thereof were connected between adjacent screw threaded rods so as to form a peripheral boundary around the table. The four rubber strips, also known as boundary strips, were spaced above the table surface a distance of about 13 centimeters. Two additional rubber strips, identical to the other rubber strips were connected between opposing boundary strips so as to divide the sample receiving surface into four equal sqaure sample holding areas.

Four test boxes, prepared as hereinbefore described and of approximately equal weight, were placed on the sample receiving surface. One of the test boxes was placed within each of the sample holding areas. The test boxes were not secured to the table in keeping with the guidance set forth in Federal Specification PPP-C-1683, Section 4.9. The test boxes had to be at approximately equal weight in order to maintain a balanced load on the table.

After the four test boxes were placed on their respective sample holding areas, the table was actuated. After a period of thirty minutes, the table was stopped. The same stiff piece of wire was inserted through the hole once again until it touched the top of the load box. The length of wire between the top of the test box and the top of the load box was measured and recorded as "final displacement".

Any increase in length from initial displacement to final displacement was converted to a percentage and recorded as "percent settling".

It was found that percent settling values at the 3105 Newtons per square meter loading (7.3 kilograms load box) were much larger than those at the 1035 Newtons per square meter loading (2.4 kilogram load box). In order to develop a meaningful pass-fail evaluation, a total settling value was calculated. The total settling value was determined by multiplying the settling value at the 1035 Newtons per square meter loading by a factor of 6.71 to obtain a product and then adding the product to the settling value at the 105 Newtons per square meter loading.

The following example is for purposes of illustration only and is not to be construed as limiting the scope of the present invention.

A number of additives were evaluated for suitability using the "Peel Test" and the "Vibrational Settling Test" set forth hereinabove. Table I contains a description of the additives together with an abbreviated code for such additives. Table II contains peel test data and vibrational settling test data for each of the additives and for a control to which no additive had been applied. The dunnage material used in the vibrational settling tests was an expanded polystyrene particulate material commercially available under the trade designation Pelaspan-Pac TM from The Dow Chemical Company. Pelaspan-Pac TM has an average maximum cross-sectional dimension of about 1.125 inches and an average minimum cross-sectional dimension of about 0.5 inch.

TABLE I

| Additive Identification | |
|---|---|
| Code | Description |
| A1 | Fumed silica |
| A2 | Ground pepper |
| A3 | A carboxylated styrene butadiene copolymer latex, the copolymer having polymerized therein styrene in an amount of 48 percent by weight of polymer, and butadiene in an amount of 50 percent by weight of copolymer, and fumaric acid in an amount of 2 percent by weight of polymer. The latex had a nominal particle size range of from about 1600 to about 2000 Angstroms, a specific gravity of 1.02 and a solids content of from about 47 to about 49 percent. The latex was available from The Dow Chemical Company under the trade designation XD-30586.20. |
| A4 | A vinylidene chloride polymer latex, the polymer having polymerized therein (a) vinylidene chloride in an amount of 82 percent by weight of polymer. (b) methyl acrylate in an amount of 18 percent by weight of polymer, (c) acrylic acid in an amount of 4 percent parts per 100 parts of (a) and (b), and (d) 0.5 parts of sodium sulfoethyl methacrylate per 100 parts of (a) and (b). The latex had a particle size of from about 1000 to about 1400 Angstroms, a viscosity, measured at 25° Centigrade using a Brookfield viscometer with a number one spindle and a rotor speed of 60 revolutions per minute, of less than about 1500 centipoise, a solids content of from about 48 to about 50 percent, and a surface tension of from 45 to about 55 dynes per centimeter. The latex was available from The Dow Chemical Company under the trade designation XD-30452.22. |
| A5 | A self cross-linking polyvinyl acetate homopolymer latex having a nominal particle size of 0.7 microns, a pH of 3.0, a specific gravity of 1.08, a viscosity, measured at 25° Centigrade using Brookfield viscometer with a number one spindle and a rotor speed of 60 revolutions per minute, of 60 centipoise, and a surface tension of about 41 dynes per centimeter. The latex was commercially available from Borden Chemical under the trade designation POLYCO ® 2136. |
| A6 | A vinyl chloride homopolymer latex having a nominal particle size of 0.16 microns, a pH of 9.5, a specific gravity of 1.18, a viscosity, measured at 25° Centigrade using a Brookfield viscometer with a number one spindle and a rotor speed of 60 revolutions per minute, of 30 centipoise, and a surface tension of 40 dynes per centimeter. The latex was commercially available from Borden Chemical under the trade designation POLYCO ® 2622. |
| A7 | A small particle size paint |

TABLE I-continued

| Additive Identification | |
|---|---|
| Code | Description |
| | pigment latex containing a styrene copolymer and having a nominal particle size of 1300 Angstroms, a nominal weight average molecular weight of 100,000 grams per mole, a solids content of 45 to 50 percent, and a specific gravity of 1.05 (at a temperature of 25° Centigrade). The copolymer had polymerized therein about 99.2 parts of styrene and about 0.8 parts of itaconic acid. The latex was commercially available from The Dow Chemical Company under the trade designation DPP 788. |
| A8 | A large particle size paint pigment latex containing a styrene copolymer and having a nominal particle size of 3500 Angstroms, a nominal weight average molecular weight of 350,000 grams per mole, a solids content of 45 to 50 percent, and a specific gravity of 1.05. The copolymer had polymerized therein about 97 parts of styrene and about 3 parts of acrylic acid. The latex was commercially available from The Dow Chemical Company under the trade designation DPP 722. |
| A9 | A vinylidene chloride polymer latex, the polymer having polymerized therein (a) vinylidene chloride in an amount of about 90 percent by weight of polymer, (b) acrylonitrile in an amount of about 5 percent by weight of polymer, (c) butyl acrylate in an amount of about 5 percent by weight of polymer, and (d) 1.4 parts of sodium sulfoethyl methacrylate per 100 parts of (a) plus (b) plus (c). The latex had a particle size of from about 1000 to about 1300 Angstroms, a viscosity, measured at 25° Centigrade using a Brookfield viscometer with a number one spindle and a rotor speed of 60 revolutions per minute, of less than about 50 centipoise, a solids content of from about 53 to 55 percent, and a surface tension of from about 60 to about 73 dynes per centimeter. The latex was commercially available from The Dow Chemical Company under the trade designation SL143. |
| A10 | A styrene copolymer latex having a nominal particle size of 300 Angstroms, a nominal weight average molecular weight of 500,000 grams per mole, a solids content of 35 to 40 percent and a specific gravity of 1.05. The copolymer had polymerized therein styrene in an amount of 96 parts by weight and acrylic acid in an amount of 4 parts by weight, both amounts being based upon copolymer weight. The latex was available from The Dow Chemical Company under the trade designation XD 8510. |
| A11 | A wallpaper wheat paste prepared by dispersing wheat flour in water, the paste containing 18 percent by weight of wheat flour. The wheat flour, which was prepared by grinding hard winter wheat, contained a non-toxic vermicide. The wallpaper paste was commercially available under the trade designation wallpaper wheat paste item #61102 from Bondex International, Inc. |
| A12 | A urethane laminating adhesive which contained (a) about 55 weight percent of an isocyanate terminated prepolymer, (b) about 32 weight percent methylene chloride, (c) about 5 weight percent of toluene, (d) about 5 percent ethyl acetate, and (e) about 2.5 weight percent free diphenylmethane diisocyanate, all percentages being based upon weight of adhesive. The adhesive had a solids content of 58 ± 1 percent and a specific gravity of 1.13. The adhesive was commecially available under the trade designation Mor-Ad 337 from Morton Chemical Company. |
| A13 | A carboxylated styrene butadiene copolymer latex, the copolymer having polymerized therein styrene in an amount of 42 percent by weight of copolymer, butadiene in an amount of 55 percent by weight of copolymer and itaconic acid in an amount of 3 percent by weight of copolymer. The latex had a nominal particle size of from about 1400 to about 1800 Angstroms, a specific gravity of 1.01 and a solids content of from about 44 to about 47 percent. The latex was commercially available from The Dow Chemical Company under the trade designation DL-219A. |

TABLE II

| Test Data | | | | | |
|---|---|---|---|---|---|
| | | | Vibrational Percent Settling | | |
| Sample | Additive | Peel Strength grams/centimeter | 1035 Newtons per square meter | 3105 Newtons per square meter | Overall Settling Value |
| 1 | — | 0 | 8 | 41 | 95 |
| 2 | A1 | 0 | 40 | 70 | 338 |
| 3 | A2 | 0 | 36 | 59 | 301 |
| 4* | A3 | 252 | 0 | 25 | 25 |
| 5* | A4 | 47 | 0 | 29 | 29 |
| 6** | A5 | 1.57 | 3 | 37 | 57 |
| 7 | A6 | 0.08 | 4 | 58 | 85 |
| 8* | A7 | 9.5 | 0 | 13 | 13 |
| 9* | A8 | 10 | 3 | 22 | 42 |
| 10* | A9 | 35 | 0 | 18 | 18 |
| 11** | A10 | 4.7 | 3 | 43 | 63 |
| 12* | A11 | 35 | 0 | 17 | 17 |
| 13* | A12 | 175 | 0 | 17 | 17 |

TABLE II-continued

| Sample | Additive | Test Data: Peel Strength grams/centimeter | Vibrational Percent Settling: 1035 Newtons per square meter | Vibrational Percent Settling: 3105 Newtons per square meter | Overall Settling Value |
|---|---|---|---|---|---|
| 14* | A13 | 190 | 0 | 24 | 24 |

*Representative of the present invention.
**Maximum acceptable overall settling values which are representative of the present invention.

From the data presented in Table II, it is clear that a disparity exists among various additives. Some, such as additives A3, A4, A7 through A9, A11, A12 and A13 markedly improve the overall settling value of dunnage material. Others, such as additives A1 and A2, actually promote settling as indicated by an increased overall settling value.

A reduction in the overall settling value is desirable because it indicates that the dunnage material will then be more effective in cushioning articles which are packaged therewith. Similar results are obtained with other additives which are identified hereinabove.

What is claimed is:

1. A loose fill packing material comprising a plurality of expanded, resilient, thermoplastic, synthetic resinous dunnage particles which particles comprise an amount of an additive deposited on at least a portion of an outer surface area of a majority of said dunnage particles which additive is selected from the group consisting of synthetic polymer latexes, pressure sensitive adhesives, glues, low molecular weight polymers which have a ring and ball softening point, as determined in accordance with American Society for Testing and Materials Test E-28, of greater than 30° Centigrade, waxes, contact cements, urethane adhesives, starch derived adhesives and protein derived adhesives, and is deposited on the dunnage particles after expansion of said dunnage particles and which additive results in the packing material having improved cushioning properties and reduces the tendency of articles to migrate through the dunnage particles, wherein the particles have an average maximum cross-sectional dimension of at least 0.5 inch.

2. The packing material of claim 1 wherein the dunnage particles are formed from a synthetic resinous material, the resinous material being selected from the group consisting of (a) polymers which comprise, in chemically combined form, at least about seventy percent by weight of at least one alkenyl aromatic compound having the general formula:

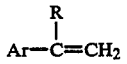

wherein Ar represents an aromatic hydrocarbon or a nuclear halohydrocarbon radical of the benzene series, and R is hydrogen or a methyl radical; (b) aliphatic olefin polymers which are normally solid polymers obtained by polymerizing at least one alpha-mono-olefinic aliphatic hydrocarbon containing from 2 to 8 carbon atoms per molecule; and (c) halogenated aliphatic olefin polymers.

3. The packing material of claim 1 wherein the dunnage particles are formed from a synthetic resinous material, the synthetic resinous material being an alkenyl aromatic polymer prepared by polymerizing at least one monomer selected from the group consisting of styrene, alpha-methylstyrene, orthomethylstyrene, para-methylstyrene, meta-methylstyrene, tertiary-butylstyrene, Ar-ethylstyrene, or Ar-chlorostyrene wherein Ar represents an aromatic hydrocarbon or a nuclear halohydrocarbon of the benzene series.

4. The packing material of claim 1 wherein the dunnage particles are formed from a synthetic resinous material, the synthetic resinous material being an aliphatic olefin polymer prepared by polymerizing at least one monomer selected from the group consisting of ethylene, propylene, butene-1, pentene-1, 3-methylbutene-1, 4-methylpentene-1, 4-methylhexene-1, or 5-methylhexene-1.

5. The packing material of claim 1 wherein the dunnage particles are formed from a synthetic resinous material, the synthetic resinous material being a homopolymer of ethylene.

6. The packing material of claim 1 wherein the additive is a synthetic polymer latex, the latex containing a polymer selected from the group consisting of styrene-butadiene copolymers, acrylic copolymers, butadiene-acrylonitrile copolymers, vinylidene chloride copolymers, vinyl chloride copolymers and vinyl alkanoate copolymers.

7. The packing material of claim 6 wherein the polymer has polymerized therein a carboxylic acid monomer in an amount of from about 0.01 to about 25 percent by weight of polymer, the carboxylic acid monomer having from about three to about twelve carbon atoms per molecule.

8. The packing material of claim 7 wherein the carboxylic acid monomer has from three to six carbon atoms per molecule.

9. The packing material of claim 6 wherein the polymer has polymerized therein styrene in an amount of from about 40 to about 70 percent by weight of polymer, butadiene in an amount of from about 15 to about 40 percent by weight of polymer and acrylic acid in an amount of from about 0.1 to about 20 percent by weight of polymer.

10. The packing material of claim 1 wherein the polymer latex has a solids content of from about 35 to about 55 percent by weight of latex.

11. The packing material of claim 1 wherein the amount of additive is from about 1400 to about 6000 grams of wet additive per cubic meter of expanded dunnage particles.

12. The packing material of claim 11 wherein the additive provides a modified peel strength of greater than about 1.5 grams per centimeter and an overall settling value of less than about 65.

13. The packing material of claim 11 wherein the additive provides a modified peel strength of greater than about 9 grams per centimeter and an overall settling value of less than about 45.

14. The packing material of claim 1 wherein the amount of additive is from about 1600 to about 3400 grams of wet additive per cubic meter of expanded dunnage partcles.

15. The packing material of claim 1 wherein the additive is deposited on at least a major portion of an outer surface area of a majority of said dunnage particles.

* * * * *

UNITED STATES PATENT AND TRADEMARK OFFICE

CERTIFICATE OF CORRECTION

PATENT NO. : 4,588,638

DATED : May 13, 1986

INVENTOR(S) : Blair E. Dolinar

It is certified that error appears in the above-identified patent and that said Letters Patent is hereby corrected as shown below:

Col. 1, line 39, "number surface" should read --number of concave surface--.

Col. 5, line 17, "5°" should read --50°--.

Col. 11, line 43, "105" should read --3105--.
Col. 12, line 47, "using Brookfield" should read --using a Brookfield--.

Col. 16, line 63, "partcles" should read --particles--.

Signed and Sealed this

Sixteenth Day of December, 1986

*Attest:*

DONALD J. QUIGG

*Attesting Officer* *Commissioner of Patents and Trademarks*